US006874182B2

(12) United States Patent
L'Hegarat et al.

(10) Patent No.: US 6,874,182 B2
(45) Date of Patent: Apr. 5, 2005

(54) OPERATING TABLE WITH ARTICULATED BLOCK

(75) Inventors: Jean-Marie L'Hegarat, Olivet (FR); Pierre Rager, Fontainebleau (FR)

(73) Assignee: FHSurgical (FR)

( * ) Notice: Subject to any disclaimer, the term of this patent is extended or adjusted under 35 U.S.C. 154(b) by 0 days.

(21) Appl. No.: 10/461,654

(22) Filed: Oct. 6, 2003

(65) Prior Publication Data

US 2004/0083549 A1 May 6, 2004

Related U.S. Application Data

(63) Continuation of application No. PCT/FR01/03587, filed on Nov. 15, 2001.

(30) Foreign Application Priority Data

Dec. 14, 2000 (FR) ..... 00 16324

(51) Int. Cl.[7] ..... A61G 7/015
(52) U.S. Cl. ..... 5/612; 5/613; 5/624
(58) Field of Search ..... 5/600, 601, 612, 5/613, 621, 624, 934

(56) References Cited

U.S. PATENT DOCUMENTS 912,588 A 2/1909 Marseilles
1,459,953 A 6/1923 Freise
1,866,696 A * 7/1932 Birman ..... 5/612
2,547,827 A * 4/1951 Logan ..... 5/612
3,405,931 A * 10/1968 Anderson ..... 5/612
4,678,171 A 7/1987 Sanders et al.
5,133,741 A 7/1992 Filho
6,001,076 A * 12/1999 Wilson et al. ..... 602/39
6,358,802 B1 * 3/2002 Oda ..... 438/301

FOREIGN PATENT DOCUMENTS

EP 0 778 016 A2 6/1997
EP 0778016 A2 * 6/1997

* cited by examiner

*Primary Examiner*—Michael Trettel
(74) *Attorney, Agent, or Firm*—DLA Piper Rudnick Gray Cary US LLP

(57) ABSTRACT

An operating table including a patient support; a block for supporting a patient's lower back which is moveable in relation to the patient support between a retracted position and a deployed position; an actuator having a first end portion linked to the patient support; and at least one mechanism for adjusting the block between the retracted and deployed positions including a first connecting rod articulatable relative to the patient support, the connecting rod being connected to a second end portion of the actuator for angular displacement and to the block for displacement of the block between the retracted position and the deployed position, and wherein the adjustment mechanism essentially rectilinear displaces the block between the retracted position and the deployed position.

12 Claims, 3 Drawing Sheets

OPERATING TABLE WITH ARTICULATED BLOCK

RELATED APPLICATION

This is a continuation of International Application No. PCT/FR01/03587 (published as WO 02/47599), with an international filing date of Nov. 15, 2001, which is based on French Patent Application No. 00/16324, filed Dec. 14, 2000.

FIELD OF THE INVENTION

This invention pertains to an operating table of the type including a block for supporting a patient's lower back, the block being mobile in relation to the structure of the operating table between a retracted position and a deployed position; and at least one mechanism for moving the block between the two positions, the mechanism being equipped with an actuator having an end linked to the structure of the operating table.

BACKGROUND

The block with which operating tables are equipped is intended to raise the lower back of a patient lying on the operating table to facilitate certain surgical interventions which require a noteworthy stretching of the tissues at the level of the pelvis. This block is currently positioned in the medial region of the operating table. It is adjusted by the operating room personnel after positioning of the patient on the operating table.

Current surgical methods increasingly require the use of medical imaging means during operations. There is therefore the requirement that numerous devices must be installed around and under the operating table which leads to the necessity of reducing as much as possible the bulk of the operating table and in particular its side frames or uprights. Consequently, the block and especially its adjustment mechanism must be as reduced in bulk as possible. The solutions known to date for the movement of the block are not very satisfactory. In particular, it is known to provide blocks formed by an inflatable bag, the height of the block being adjusted by means of the amount of air introduced into the inflatable bag. When the bag is not completely inflated to obtain an intermediary elevation of the patient, the block is too soft which prevents satisfactory immobilization of the patient.

Also known are blocks whose adjustment mechanism comprises a rack integral with the block, the rack cooperating with a pinion gear driven by a motor integral with the table's platform.

Such an arrangement is relatively bulky because of the rack's displacement course, the rack passing over the table's side frames under the platform when the block is in the retracted position.

It would therefore be advantageous to provide an operating table equipped with a mobile block whose adjustment mechanism is not bulky.

SUMMARY OF THE INVENTION

This invention relates to an operating table including a patient support, a block for supporting a patient's lower back which is moveable in relation to the patient support between a retracted position and a deployed position, and an actuator having a first end portion linked to the patient support, and at least one mechanism for adjusting the block between the retracted and deployed positions including a first connecting rod articulatable relative to the patient support, the connecting rod being connected to a second end portion of the actuator for angular displacement and to the block for displacement of the block between the retracted position and the deployed position, and wherein the adjustment mechanism essentially rectilinearly displaces the block between the retracted position and the deployed position.

BRIEF DESCRIPTION OF THE DRAWINGS

Better comprehension of the invention will be obtained by reading the description below presented solely as an example and with reference to the attached drawings in which.

DETAILED DESCRIPTION

Figure 1:
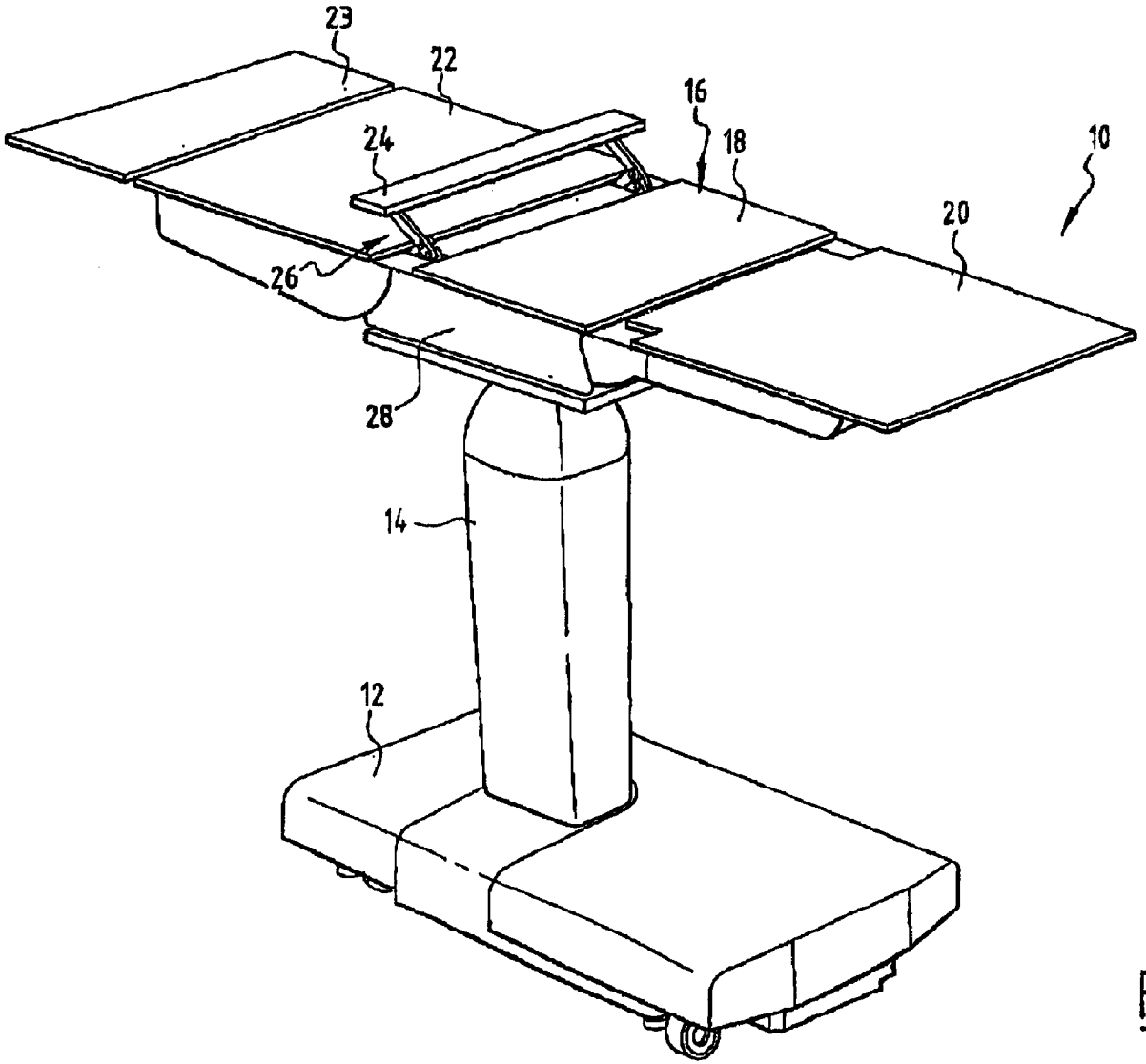
FIG. 1 is a schematic view in perspective of an operating table according to the invention.

The invention is an operating table wherein the or each adjustment mechanism comprises a first connecting rod articulated in relation to the structure of the operating table, the connecting rod being connected to a second end of the actuator for its angular displacement and to the block for the displacement of the block between its retracted position and its deployed position.

According to particular modes of implementation, the invention comprises one or more of the following characteristics:

the or each adjustment mechanism has a second connecting rod providing the link of the first connecting rod to the block, the second connecting rod being linked to the block and to the structure of the operating table, with the first and second connecting rods being articulated in relation to each other;

the or each adjustment mechanism comprises a third connecting rod providing the link of the second connecting rod to the structure of the operating table, third connecting rod being articulated in relation to the structure of the operating table and in relation to the second connecting rod;

the axis of articulation defined between the first connecting rod and the second connecting rod is located between the axis of articulation defined between the second connecting rod and the third connecting rod and the linkage point of the block to the second connecting rod;

the axis of articulation defined between the first connecting rod and the second connecting rod is closer to the axis of articulation defined between the second connecting rod and the third connecting rod than the linkage point of the block to the second connecting rod;

the actuator is a rectilinear displacement actuator which is articulated at its first end in relation to the structure of the operating table and is articulated at its second end in relation to the first connecting rod;

the axis of articulation defined between the second end of the actuator and the first connecting rod is located between the axis of articulation of the first connecting rod and the structure of the operating table and the axis of articulation defined between the first connecting rod and the second connecting rod;

the axis of articulation defined between the second end of the actuator and the first connecting rod is closer to the axis of articulation defined between the first connecting rod and the structure of the operating table than the axis of articulation between the first connecting rod and the second connecting rod;

the axis of the actuator extends essentially perpendicular to the direction of displacement of the block;

the block is articulated in relation to the adjustment mechanism and it comprises stops limiting the angular passage of the block in relation to the adjustment mechanism;

the or each adjustment mechanism is designed for an essentially rectilinear displacement of the block between its retracted position and its deployed position;

the or each adjustment mechanism has at least one supplementary degree of freedom in relation to the structure of the operating table; and the articulation provided at the first end of the actuator has at least one supplementary degree of freedom enabling a displacement between the actuator and the structure of the operating table perpendicularly to the axis of rotation.

Turning now to the drawings, the operating table 10 represented in FIG. 1 comprises a base 12, a support column 14 and a patient-support platform 16 attached to the top end of the column 14. The platform 16 is constituted of a set of elements which are mobile in relation to each other to modify the configuration on which the patient rests.

In particular, the platform 16 comprises a central plate 18 forming a baseplate at one end of which is attached a leg rest 20 and at the other end of which is articulated a backrest 22. In FIG. 1, the backrest 22 is represented as aligned in the extension of the support plate 18. However, this backrest can be raised or lowered. The backrest is extended by a removable headrest 23.

In the region of articulation of the backrest 22 on the support plate 18 is installed an articulated block 24. This articulated block 24 is supported by two adjustment mechanisms 26 partially housed in the posts or side rails 28 of the baseplate support 18.

The block 24 is constituted of a rectangular plate designed to support the patient's lower back. This plate can be slightly rounded.

Figure 2:
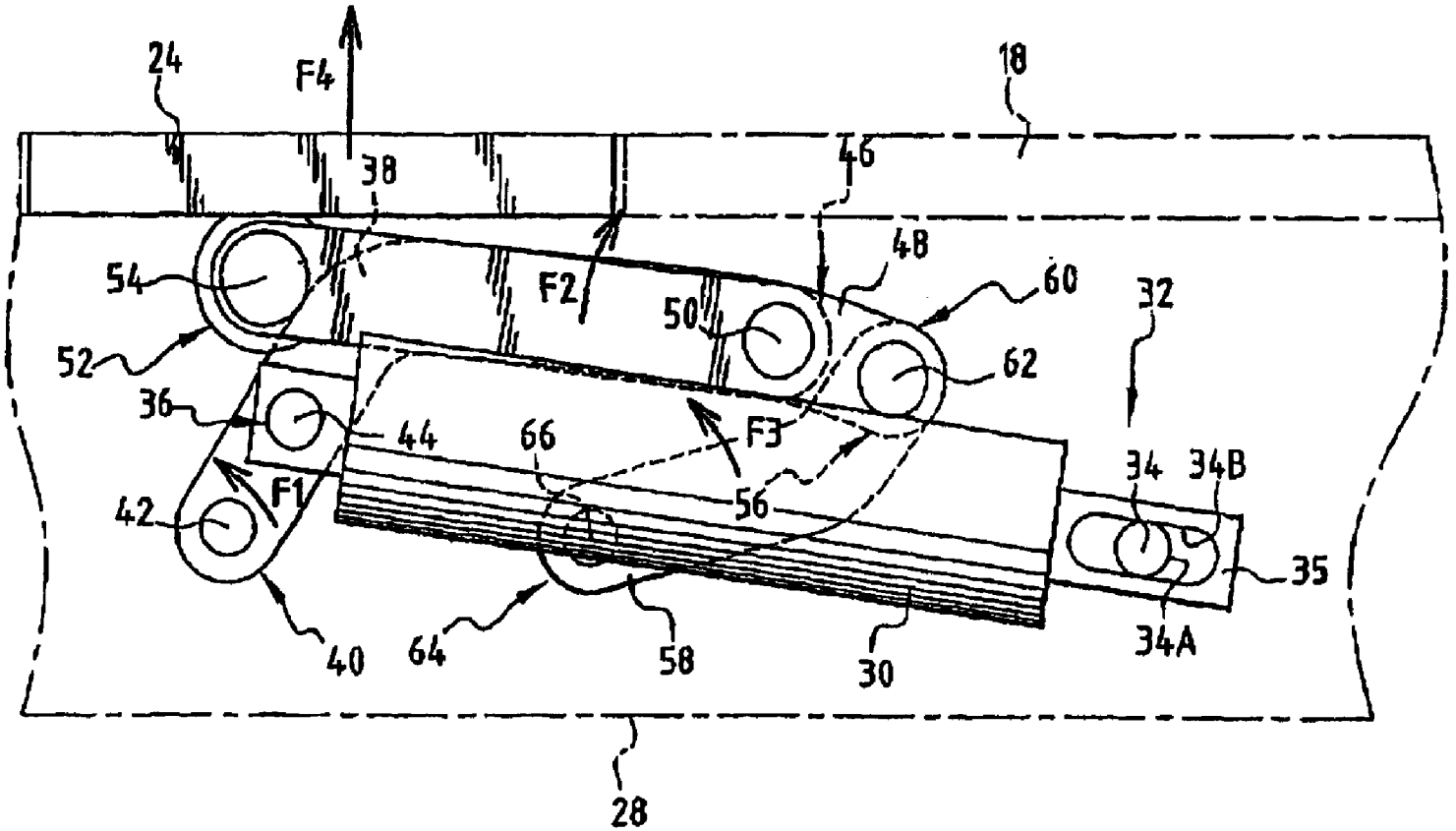
FIGS. 2 and 3 are elevation views of the block and the adjustment mechanism, partially housed in a side frame of the table, the block being represented respectively in its retracted position and in its deployed position.
Figure 3:
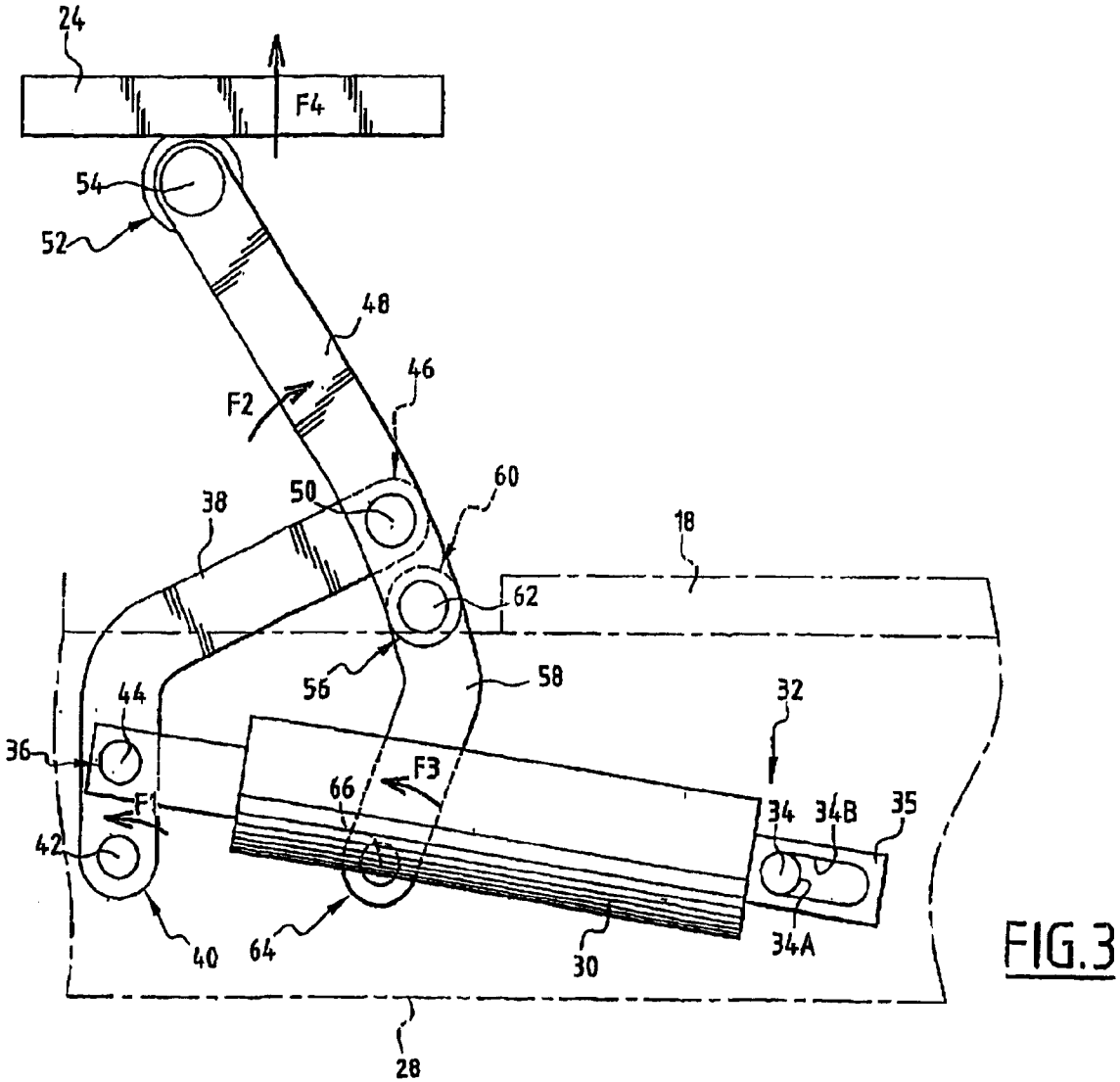

The block is mounted such that it can be moved between a retracted position illustrated in FIG. 2 in which the block 24 extends the baseplate 18 and is integrated with it and a deployed position illustrated in FIGS. 1 and 3 in which the block 24 is mounted vertically in relation to the surface of the baseplate 18 and protrudes in relation to the surface of the baseplate.

The two adjustment mechanisms 26 for the block are identical; they are located at the two ends of the block 24, i.e., at either end of the longitudinal axis of the table.

One of the adjustment mechanisms 26 of the block 24 is represented alone in FIGS. 2 and 3.

It comprises a rectilinear displacement actuator 30 which is constituted, for example, by a hydraulic screw jack connected to a source of fluid under pressure from the operating table system.

The actuator 30 is advantageously housed completely in the sidepiece 28. Its axis extends essentially along the length of the sidepiece irrespective of the extension status of the actuator.

A first end 32 of the body of the screw jack is articulated around a hinge pin 34 in relation to the sidepiece 28 forming a structural element of the operating table. The hinge pin 34 extends perpendicularly to the sidepiece 28 and parallel to the surface of the baseplate 18.

The articulation at the first end 32 comprises a hinge pin 34A integral with the sidepiece 28. The pin is received in an oblong slot 34B in a tab 35 integral with the body of the screw jack. The large axis of the slot 34B is directed along the direction of expansion of the screw jack 30.

The end of the mobile rod of the screw jack 30 forming a second end 36 of the actuator is connected to a first connecting rod 38 of the adjustment mechanism. This first connecting rod 38 is articulated at one end 40 in relation to a sidepiece 28 along a hinge pin 42 extending parallel to the hinge pin 34.

The second end 36 of the screw jack is articulated in the moving part of the first connecting rod 38 around a hinge pin 44.

The connecting rod 24 is preferably connected indirectly to the other end 46 of the first connecting rod 38.

For this purpose, the first connecting rod 38 is articulated in the running part of a second connecting rod 48 around a hinge pin 50. The connecting rod 24 is connected at one end 52 of the second connecting rod 48. This connection is advantageously constituted by a hinge pin 54.

The hinge pin 54 extends along the width of the block thereby enabling a swinging upon itself of the block when supporting a patient which enhances the patient's comfort.

The hinge 54 has two stop designed to limit the angular passage of the block around a median position illustrated in FIG. 3. In particular, these stops can prevent the block's edge from coming into contact with the patient.

At its other end 56, the second connecting rod 48 is connected to the operating table's structure and more precisely to the side rail 28.

For this purpose, a third connecting rod 58 is articulated from one of its ends 60 to the end 56 of the second connecting rod 48. This articulation is implemented around a hinge pin 62.

At its other end 64, the third connecting rod 58 is articulated in relation to the side rail 28 around a hinge pin 66.

All of the hinge pins of the adjustment mechanism 26 extend parallel to each other and transversely to the displacement plane of the screw jack 30 and the connecting rods 38, 48 and 58.

Moreover, the hinge pins 34, 42 and 66, respectively of the screw jack, the first connecting rod and the third connecting rod are aligned in relation to the side rail 28.

Moreover and advantageously, in order to reduce the displacement course of the end 36 of the actuator and its angular passage around the hinge pin, the hinge pin 44 is closer to the hinge pin 42 than the hinge pin 50. Similarly, on the second connecting rod 48, the hinge pin 50 is closer to the hinge pin 62 than the connection point of the connecting rod 24 to the second connecting rod, i.e., the hinge pin 54.

The adjustment mechanism represented in the figures enables an essentially rectilinear displacement of the block 24 along a direction extending perpendicularly to the plane defined by the baseplate 18 and the side rails 28.

This displacement is implemented between a retracted position in which the adjustment mechanism is in the position illustrated in FIG. 2, and its deployed position in which the adjustment mechanism is in the position illustrated in FIGS. 1 and 3.

The displacements of the elements of the adjustment mechanisms 26 take place in parallel planes extending perpendicularly to the baseplate 18 and along the length of the table.

From the position of the adjustment mechanism illustrated in FIG. 2, when the screw jack 30 is activated, it pushes the first connecting rod 38 in the direction of the arrow F1 so as to cause the angular displacement of it around the hinge pin 42. Upon this displacement, the end 46 of the first connecting rod causes the lifting of the second connecting rod 48 in relation to the side rail 28. In order to accomplish this, the third connecting rod 58 rotates around the hinge pin 66 in the direction of the arrow F3. Simultaneous with the lifting of the second connecting rod, it is displaced angularly around the hinge pin 62 under the action of the first connecting rod 38, this angular displacement taking place in the direction of the arrow F2.

It can be understood that the angular displacement of the first connecting rod 38 according to a first direction combined with the angular displacement induced by the second connecting rod 48 in an opposite direction leads to a vertical displacement of the block 28 essentially along a rectilinear trajectory illustrated by the arrow F4.

Due to the position of the hinge pins 44 and 50 along the length of the first and second connecting rods, a slight displacement of the mobile end 36 of the screw jack causes a displacement of large amplitude of the block 24. Moreover, the axis of the actuator always extends essentially perpendicularly to the direction of the displacement of the block 24.

The displacement of the block 24 to its retracted position is attained in a similar and inverse manner under the action of the screw jack 30 pulling back the first connecting rod 38.

In the retracted position of the block, the three connecting rods 38, 48 and 58 are housed inside the side rail 28. They then extend along the length of the screw jack 30.

The operating table described here has a block whose adjustment mechanism is of a greatly reduced bulk. In fact, it can be completely retracted within the side rails of the operating table when the block is in the retracted position.

The use of connecting rods articulated to each other makes it possible to avoid the use of elements that have to engage in translational motion with the exception of the screw jack, thus reducing the space required for the rectilinear displacement of these elements.

The presence of the oblong hole 34B in the tab 35 provides a supplementary degree of freedom for the movement of the screw jack in relation to the pin 34A. This degree of freedom makes it possible to limit the retraction of the block under the action of the actuator in the case in which an object or a limb might obstruct the displacement of the block. Thus, the risks of damage for an object or a limb caught under the block are reduced. In a variant, the supplementary degree of liberty of the adjustment mechanism can be obtained by implementation of an elastic connection tab 35.

What is claimed is:

1. An operating table comprising:

a patient support;

a block for supporting a patient's lower back which is moveable in relation to the patient support between a retracted position and a deployed position;

an actuator having a first end portion linked to the patient support; and at least one mechanism for adjusting the block between the retracted and deployed positions comprising a first connecting rod having an end portion pivotally affixed to the patient support, the connecting rod being connected to a second end portion of the actuator for angular displacement and to the block for displacement of the block between the retracted position and the deployed position, and wherein the adjustment mechanism essentially rectilinearly displaces the block between the retracted position and the deployed position.

2. An operating table comprising:

a patient support;

a block for supporting a patient's lower back which is moveable in relation to the patient support between a retracted position and a deployed position;

an actuator having a first end portion linked to the patient support;

at least one mechanism for the block between the retracted and deployed positions comprising a first connecting rod articulatable relative to the patient support, the connecting rod being connected to a second end portion of the actuator for angular displacement and to the block for displacement of the block between the retracted position and the deployed position, wherein the adjustment mechanism essentially rectilinearly displaces the block between the retracted position and the deployed position; and a second connecting rod providing connection of the first connecting rod to the block, the second connecting rod being connected to the block and to the patient support, and the first and second connecting rods are articulatable in relation to each other.

3. The operating table according to claim 2, wherein the mechanism comprises a third connecting rod providing connection of the second connecting rod to the patient support, the third connecting rod being articulatable in relation to the patient support and in relation to the second connecting rod.

4. The operating table according to claim 3, wherein an axis of articulation defined between the first connecting rod and the second connecting rod is located between an axis of articulation defined between the second connecting rod and the third connecting rod and a linkage point of the block to the second connecting rod.

5. The operating table according to claim 4, wherein the axis of articulation defined between the first connecting rod and the second connecting rod is closer to the axis of articulation defined between the second connecting rod and the third connecting rod than the linkage point of the block to the second connecting rod.

6. The operating table according to claim 2, wherein an axis of articulation defined between the second end portion and the first connecting rod is located between an axis of articulation of the first connecting rod and the patient support and an axis of articulation defined between the first connecting rod and the second connecting rod.

7. The operating table according to claim 6, wherein the axis of articulation defined between the second end portion and the first connecting rod is closer to the axis of articulation defined between the first connecting rod and the patient support than the axis of articulation between the first connecting rod and the second connecting rod.

8. An operating table comprising:

a patient support;

a block for supporting a patient's lower back which is moveable in relation to the patient support between a retracted position and a deployed position;

an actuator having a first end portion linked to the patient support; and at least one mechanism for adjusting the block between the retracted and deployed positions comprising a first connecting rod articulatable relative to the patient support, the connecting rod being connected to a second end portion of the actuator for angular displacement and to the block for displacement of the block between the retracted position and the deployed position, wherein the adjustment mechanism essentially rectilinearly displaces the block between the retracted position and the deployed position, and wherein the actuator is a rectilinear displacement actuator, the actuator is articulatable at its first end in relation to the patient support and is articulatable at the second end portion in relation to the first connecting rod.

9. The operating table according to claim 8, wherein an axis extending along the actuator extends essentially perpendicular to the direction of displacement of the block.

10. The operating table according to claim 8, wherein articulation provided at the first end portion of the actuator has at least one supplementary degree of freedom enabling a displacement between the actuator and the patient support perpendicularly to a hinge pin in the patient support.

11. An operating table comprising:

a patient support;

a block for supporting a patient's lower back which is moveable in relation to the patient support between a retracted position and a deployed position;

an actuator having a first end portion linked to the patient support; and at least one mechanism for adjusting the block between the retracted and deployed positions comprising a first connecting rod articulatable relative to the patient support, the connecting rod being connected to a second end portion of the actuator for angular displacement and to the block for displacement of the block between the retracted position and the deployed position, wherein the adjustment mechanism essentially rectilinearly displaces the block between the retracted position and the deployed position, and wherein the block is articulated in relation to the adjustment mechanism and comprises stops limiting angular passage of the block in relation to the adjustment mechanism.

12. An operating table comprising:

a patient support;

a block for supporting a patient's lower back which is moveable in relation to the patient support between a retracted position and a deployed position;

an actuator having a first end portion linked to the patient support; and at least one mechanism for adjusting the block between the retracted and deployed positions comprising a first connecting rod articulatable relative to the patient support, the connecting rod being connected to a second end portion of the actuator for angular displacement and to the block for displacement of the block between the retracted position and the deployed position, wherein the adjustment mechanism essentially rectilinearly displaces the block between the retracted position and the deployed position, and wherein the adjustment mechanism has at least one supplementary degree of freedom in relation to the patient support.

* * * * *